US007661338B2

(12) United States Patent
Kochling

(10) Patent No.: US 7,661,338 B2
(45) Date of Patent: Feb. 16, 2010

(54) SOCKET ASSEMBLY FOR A GATE VALVE WRENCH

(76) Inventor: Edmund T. Kochling, 47 Hanson Rd., Charlton, MA (US) 01507

( * ) Notice: Subject to any disclaimer, the term of this patent is extended or adjusted under 35 U.S.C. 154(b) by 0 days.

(21) Appl. No.: 11/799,708

(22) Filed: May 1, 2007

(65) Prior Publication Data

US 2008/0271577 A1 Nov. 6, 2008

(51) Int. Cl.
*B25B 13/06* (2006.01)
*B25B 13/00* (2006.01)

(52) U.S. Cl. ..... 81/121.1; 81/124.6

(58) Field of Classification Search ..... 81/124.6, 81/121.1

See application file for complete search history.

(56) References Cited

U.S. PATENT DOCUMENTS

| | | | | | |
|---|---|---|---|---|---|
| 876,675 | A * | 1/1908 | Albrecht | 7/138 |
| 1,365,071 | A * | 1/1921 | Abegg | 81/124.6 |
| 1,394,539 | A * | 10/1921 | Danielson | 81/124.6 |
| 2,963,929 | A * | 12/1960 | Barnes | 81/62 |
| 4,126,063 | A * | 11/1978 | Palmer | 81/124.6 |
| 4,334,443 | A * | 6/1982 | Pearson | 81/55 |
| 4,671,141 | A * | 6/1987 | Hanson | 81/53.2 |
| 4,806,170 | A * | 2/1989 | Doty | 134/9 |
| 5,791,209 | A | 8/1998 | Marks | |
| 6,085,619 | A | 7/2000 | Blake et al. | |
| 6,598,498 | B1 | 7/2003 | Pigford et al. | |
| 6,928,906 | B1 | 8/2005 | Marks | |
| 7,036,402 | B1 * | 5/2006 | Marks et al. | 81/177.2 |

* cited by examiner

*Primary Examiner*—Bryan R Muller
(74) *Attorney, Agent, or Firm*—Kriegsman & Kriegsman

(57) ABSTRACT

A socket assembly for a gate valve wrench includes a socket, a support member adapted to mount on the wrench and a fastener for connecting the socket to the support member in such a manner so as to retain the socket fixed in place on the gate valve wrench. The socket includes a cylindrical piece with an inner surface shaped to include twelve inwardly protruding ridges that together define an interior cavity. In use, the socket assembly can be used in conjunction with the wrench to turn a rounded gate valve operating nut. Specifically, with the socket assembly attached to the wrench, the socket is forcibly driven down over the rounded nut such that each ridge digs into the rounded nut. Firmly engaged by the socket, the rounded nut can then be operated using the wrench.

8 Claims, 7 Drawing Sheets

SOCKET ASSEMBLY FOR A GATE VALVE WRENCH

BACKGROUND OF THE INVENTION

The present invention relates generally to valves located in underground fluid-carrying conduits and more particularly to tools used to operate said valves.

Underground fluid-carrying conduits, such as water lines, fuel lines, sewer lines and the like, typically have gate valves installed at periodic locations. In this manner, one may shut off the flow of the fluid through a desired length of the conduit by closing selected gate valves. Examples of conditions that require closure along particular segments of the conduit include, but are not limited to, emergency conditions (e.g., a water main break or gas leak) and construction projects (e.g., tapping the water system for a new building into a preexisting underground water main).

Referring now to FIG. 1, there is shown a gate valve which is well-known in the art and which is identified generally by reference numeral 11. Gate valve 11 includes a shortened conduit 13 that is shaped to define first and second openings 15-1 and 15-2 that are in fluid communication with one another. A movable gate (not shown), which is typically rounded or rectangular in shape, is located within conduit 13 between first and second openings 15-1 and 15-2 and serves to regulate the flow of fluid therebetween.

The gate is typically connected to a vertically disposed stem 17 which at least partially protrudes out from conduit 13. An enlarged operating nut 19 is traditionally mounted onto the free end of stem 17, operating nut 19 typically having a square shape in both longitudinal and lateral cross-section. In this manner, it is to be understood that fluid flow through valve 11 can be manually regulated through the rotation of operating nut 19 (i.e., clockwise rotation to close valve 11 and counterclockwise rotation to open valve 11).

Because gate valves are commonly disposed a considerable distance underground (e.g., often several feet beneath the surface of a road), an elongated wrench is commonly used to turn operating nut 19. In this manner, the valve can be easily regulated through a relatively small access hole in the ground, which is highly desirable.

Referring now to FIG. 2, there is shown one well-known type of wrench which is often used to turn operating nut 19, the wrench being identified generally by reference numeral 21. Wrench 21 is typically constructed out of a strong, rigid and durable material, such as cast iron or steel, and comprises a square-shaped key 23 which is connected to an elongated T-bar 25 through an inverted U-shaped stirrup, or strut, 27.

As can be seen, key 23 is constructed as an elongated band that is configured so as to define a square-shaped central opening 24 therein. It is to be understood that key 23 is sized and shaped to fittingly receive operating nut 19 within opening 24.

T-bar 25 comprises an elongated arm 29 which is connected to key 23 through stirrup 27, with arm 29 preferably being several feet in length. An orthogonally disposed handle 31 is formed onto the free end of arm 29 so as to provide T-bar 25 with its T-shaped design. Although T-bar 25 is represented herein as being generally square-shaped in lateral cross-section, it is to be understood that T-bar 25 is often circular or rectangular in lateral cross-section as well.

In use, wrench 21 is commonly used to operate an underground gate valve 11 in the following manner. Specifically, key 23 of wrench 21 is disposed through a small access hole (either preexisting or newly created) in the ground directly above the gate valve 11 to be regulated. Due to the considerable length of arm 29, key 23 can be disposed several feet below ground by an operator who remains above ground. By grasping handle 31, the operator orientates key 23 such that operating nut 19 inserts into opening 24. Because key 23 and operating nut 19 have complementary square-shaped designs, it is to be understood that operating nut 19 fits loosely within key 23. With nut 19 positioned within key 23 as described above, the user manually rotates T-bar 25 using handle 31. The rotation of handle 31 similarly rotates operating nut 19 in such a manner so as to open and/or close gate valve 11.

A gate valve may sit underground for many years, even decades, without being turned. As a result, it has been found that an infrequently operated gate valve often becomes stuck or otherwise difficult to regulate (e.g., due to the accumulation of dirt, grime or other similar forms of debris between moving parts). Accordingly, in order to move a stuck gate valve, an operator is typically required to rotate the wrench handle back and forth a number of times to loosen the gate mechanism of the valve. Because the operating nut often fits rather loosely within the wrench key, this process of loosening the gate mechanism commonly causes the wrench to round (i.e., strip) the operating nut. With the operating nut rounded, it is to be understood that a conventional gate valve wrench (e.g., of the type shown in FIG. 2) is no longer able to adequately grip the operating nut and thereby regulate the gate valve.

The inability to operate a gate valve using a traditional gate valve wrench introduces a number of notable shortcomings.

As a first shortcoming, the inability to operate a gate valve using a traditional gate valve wrench often necessitates that the access hole in the ground be significantly expanded so as to permit a worker and/or large machinery to reach the rounded operating nut. This expansion of the access hole is extremely costly due to the significant amount of labor and machinery required to excavate. In addition, the expansion of the access hole is rather time consuming and disruptive in nature.

As a second shortcoming, the inability to operate a gate valve using a traditional gate valve wrench creates a potentially dangerous condition. Specifically, because a more expansive and time-consuming process is required to rotate the rounded nut, hazardous conditions that require an immediate shut-off of selected gate valves (e.g., a gas leak or water main break) can remain untreated for unacceptably long periods.

Accordingly, in U.S. Pat. No. 7,036,402 to J. S. Marks et al. (hereinafter the '402 patent), there is disclosed a water main T-bar that is configured to work in combination with a socket tool, the combination forming a key for actuating an underground valve in a water main, sewer line, gas line, petroleum pipeline, fuel line, etc. In the '402 patent, it is suggested that the socket tool may be of the type shown in U.S. Pat. No. 6,928,906 to J. S. Marks (hereinafter the '906 patent). The socket tool disclosed in the '906 patent features spring loaded pins that adapt or conform to the valve stem, handle or nut shape and size. The pins are bundled in parallel inside a housing and collectively gain purchase on and apply the torque necessary to open or close the valve. In this manner, the socket tool may be used in conjunction with the T-bar to actuate a gate valve with a decayed operating nut.

Although well known in the art, the water main T-bar and adaptor disclosed in the '402 and '906 patents suffer from a couple notable shortcomings.

As a first shortcoming, the self-forming socket disclosed in the '906 patent is rather mechanically complex in nature, thereby rendering it considerably expensive to manufacture and purchase. Due to the high cost associated with such sockets, most municipalities are limited in the number of self-forming sockets that they can purchase. As a result, it has been found that certain emergency situations which require the immediate shut-off of selected gate valves are unacceptably delayed until operators can locate and acquire the socket and complementary T-bar.

As a second shortcoming, the self-forming socket disclosed in the '906 patent is not designed for attachment to a traditional water main T-bar. Rather, the self-forming socket is designed for attachment with the T-bar disclosed in the '402 patent. As a result, municipalities that are to consider use the socket disclosed in the '906 patent are additionally required to purchase a new T-bar, thereby increasing expenses.

As a third shortcoming, the self-forming socket disclosed in the '906 patent is relatively large in size. As a result, the socket is often incapable of being passed through many pre-existing access holes in the ground. Consequently, a time-consuming and expensive excavation process is often required to expand the size of the access hole.

As a fourth shortcoming, the self-forming socket disclosed in the '906 patent has been found to be ineffective when used to turn operating nuts that are considerably round in lateral cross-section. Specifically, it has been found that the parallel pins are unable to effectively grab an operating nut that does not include at least one flattened surface.

As a fifth shortcoming, the self-forming socket disclosed in the '906 patent is often difficult to use in certain conditions. Most notably, when disposed underground, dirt and rocks have been found to accumulate within the socket and can compromise the ability of the spring-biased pins to be displaced.

SUMMARY OF THE INVENTION

It is an object of the present invention to provide a socket assembly which is adapted for attachment to a gate valve wrench which includes a square-shaped key that is connected to an elongated T-bar through an inverted U-shaped stirrup.

It is another object of the present invention to provide a socket assembly of the type as described above which can be used to regulate a gate valve with a rounded operating nut.

It is yet another object of the present invention to provide a socket assembly of the type as described above which has a limited number of parts, is inexpensive to manufacture and is easy to use.

According to feature of the present invention, there is provided a socket assembly adapted for attachment to a wrench, the wrench including a key coupled to an elongated T-bar, the key being shaped to define a square-shaped central opening, the socket assembly comprising (a) a socket; (b) a support member adapted to mount on the wrench; and (c) a fastener for connecting the socket to the support member.

According to another feature of the present invention, there is provided a method of capping the operating nut of a valve using a wrench, the wrench comprising a key coupled to an elongated T-bar, the key being shaped to define a square-shaped central opening, the method comprising the steps of (a) providing a socket assembly that comprises a socket, a support member adapted to mount on the wrench, and a fastener for connecting the socket to the support member, wherein the socket includes an open front end, a rear end, an inner surface and an outer surface, the inner surface being shaped to define an interior cavity; (b) attaching the socket assembly to the wrench so that the socket overlies the square-shaped central opening in the key; (c) filling the interior cavity of the socket with an adhesive; (d) manipulating the wrench so that the socket covers the operating nut; (e) allowing the adhesive to cure so as to yield the socket affixed to the operating nut; and (f) withdrawing the wrench from the operating nut with sufficient force so as to break at least one of the fastener and the support member.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
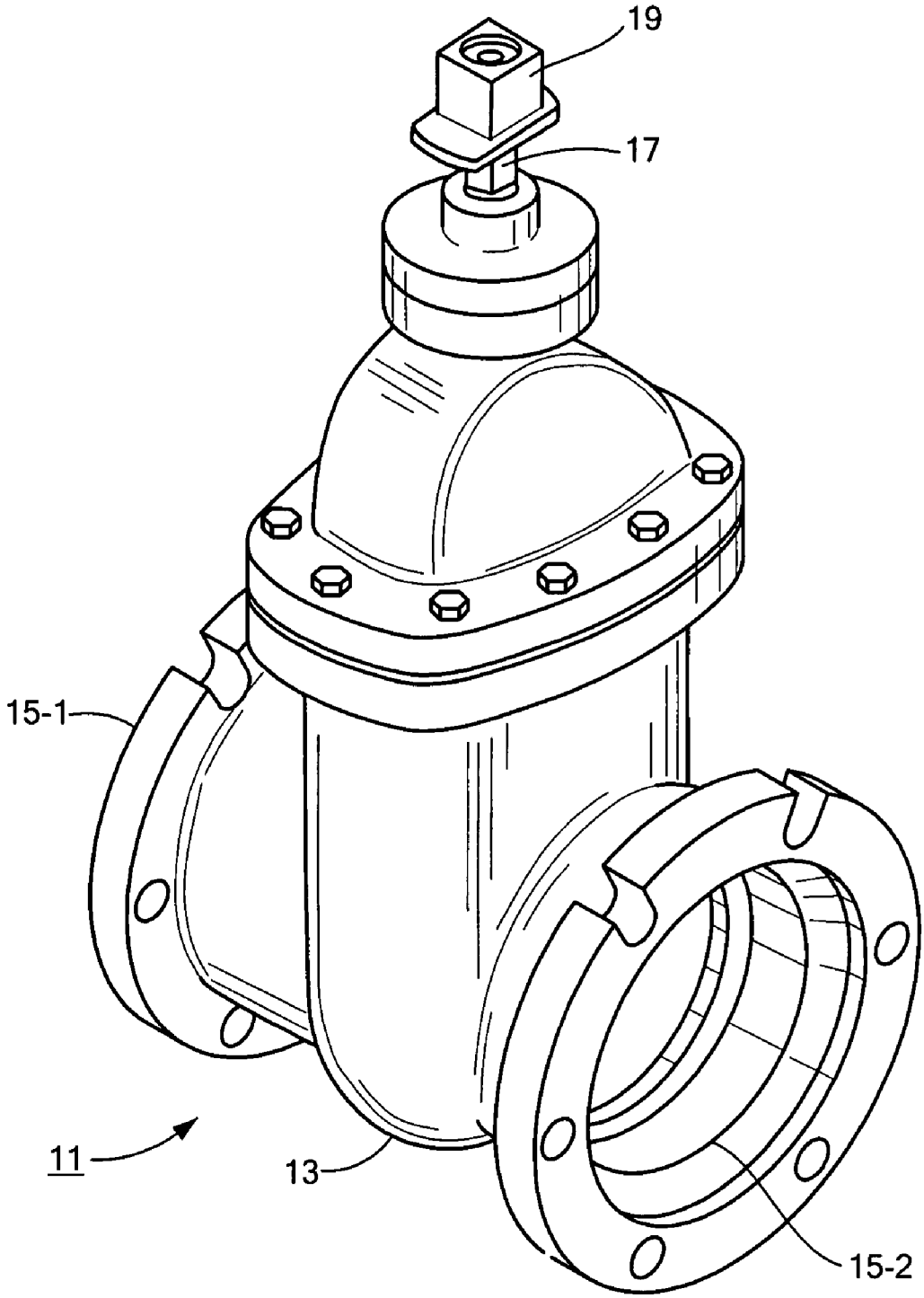
FIG. 1 PRIOR ART
FIG. 1 is a top perspective view of a gate valve which is well known in the art.
Figure 2:
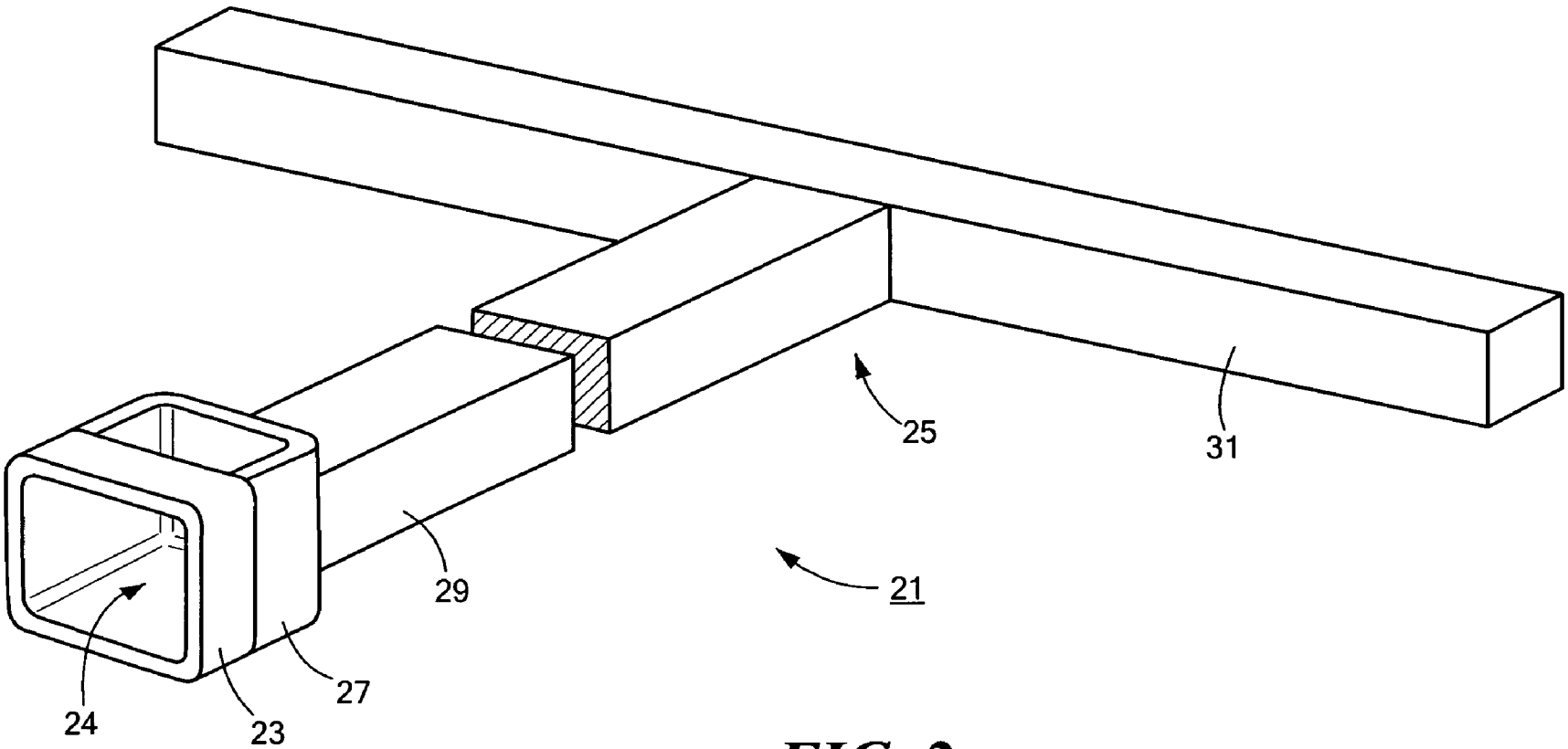
FIG. 2 PRIOR ART
FIG. 2 is a fragmentary bottom perspective view of a prior art wrench which is commonly used to operate the gate valve shown in FIG. 1.
Figure 3:
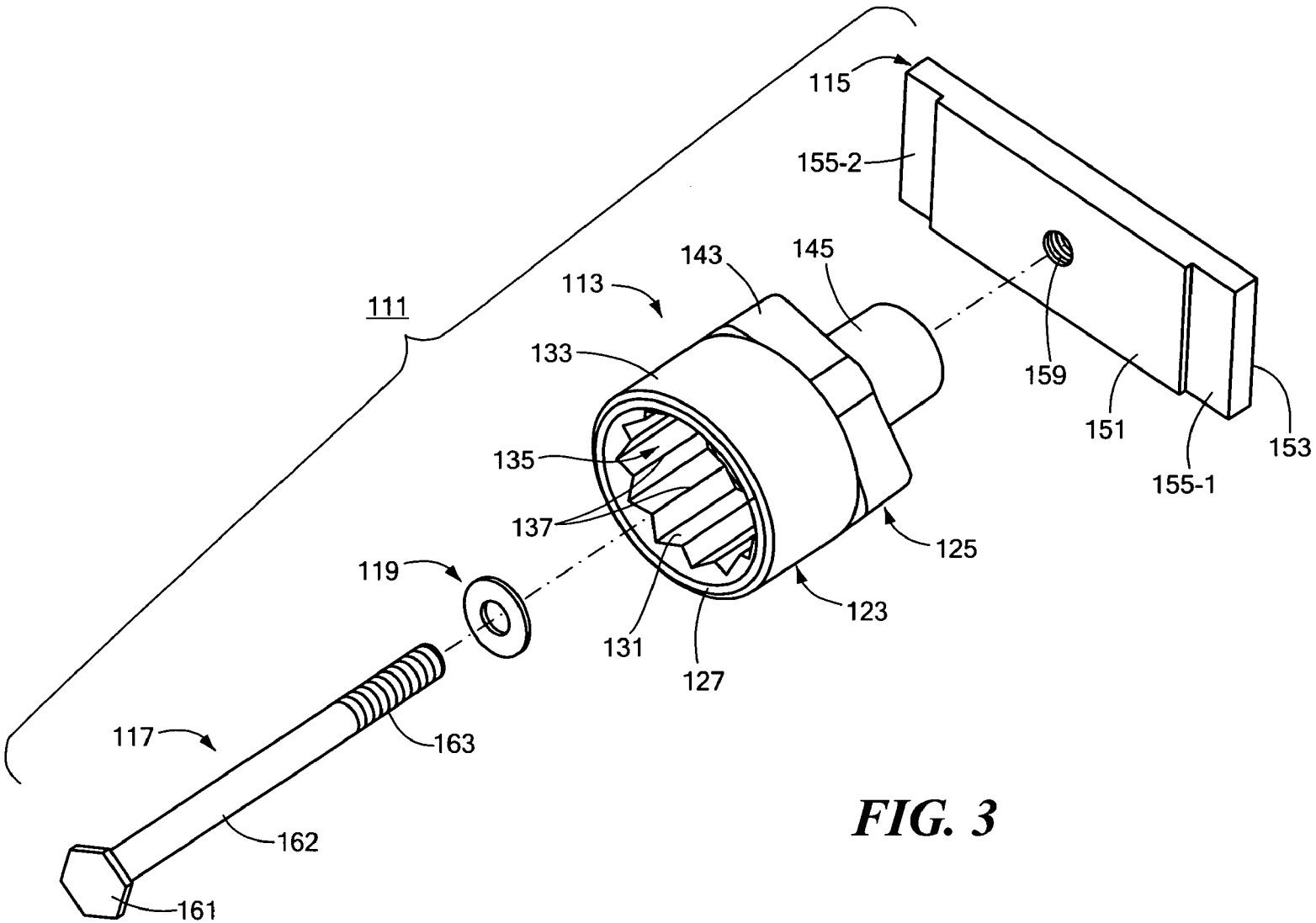
FIG. 3 is an exploded perspective view of a socket assembly designed for attachment to a conventional gate valve wrench, the socket assembly being constructed according to the teachings of the present invention.

Referring now to FIG. 3, there is shown a socket assembly constructed according to the teachings of the present invention, the socket assembly being identified generally by reference numeral 111. As will be described further in detail below, socket assembly 111 is designed for attachment to a conventional gate valve wrench (for example, of the type shown in FIG. 2). In this manner, it is to be understood that socket assembly 111 can be used in connection with the gate valve wrench to control a gate valve (for example, of the type shown in FIG. 1) which has an operating nut that is decayed, rounded or otherwise worn.

Construction of Socket Assembly 111

Socket assembly 111 comprises a socket 113, a support member 115, a fastener 117 and a washer 119.

Figure 4B:
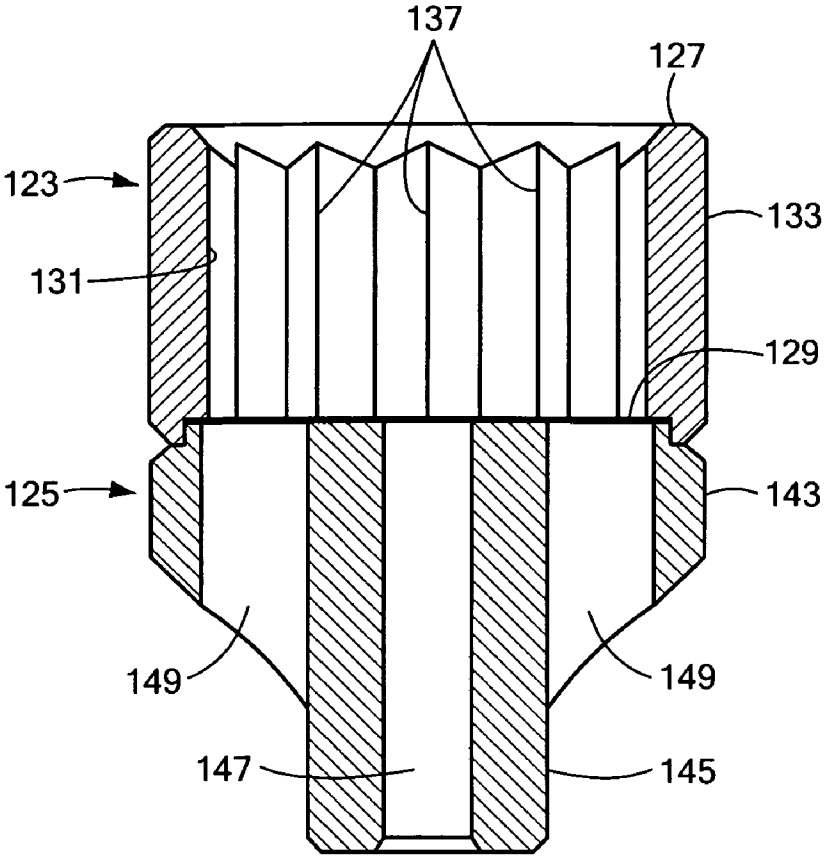
FIGS. 4(*a*) through 4(*c*) are front plan, section, and rear plan views, respectively, of the socket shown in FIG. 3.
Figure 4A:
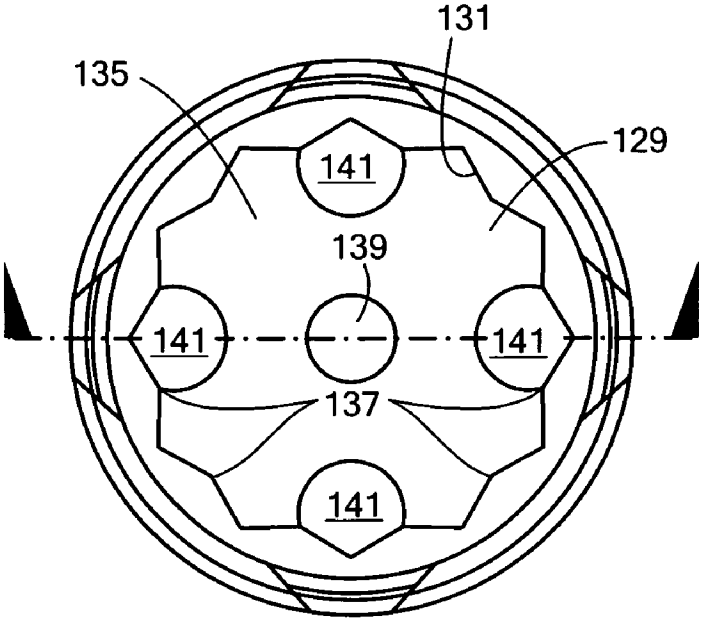
Figure 4C:
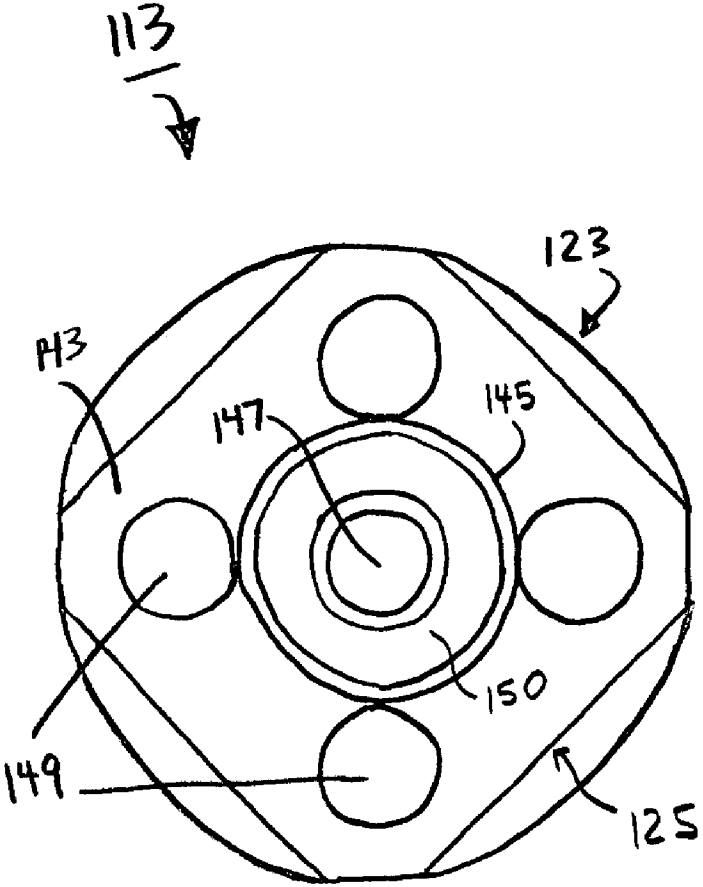

As seen most clearly in FIGS. 3, 4(*a*) and 4(*b*), socket 113 is preferably constructed as two separate pieces, each of said pieces being made from a rigid and durable material, such as hardened steel. Specifically, socket 113 includes a front piece 123 and a rear piece 125 that are secured together by conventional means, such as by crimping or welding. Although represented herein as having a two piece construction, it is understood that socket 113 could be alternatively constructed as a unitary member without departing from the spirit of the present invention.

Front piece 123 is generally cylindrical in shape and includes an open front end 127, a substantially closed rear end 129, an inner surface 131 and an outer surface 133. As will be described further below, inner surface 131 defines an interior cavity 135 which is sized and shaped to receive the operating nut of a gate valve to be controlled using socket assembly 111 in combination with a conventional valve wrench.

As seen most clearly in FIG. 4(*a*), inner surface 131 is provided with twelve inwardly protruding, sharpened ridges, or points, 137, with adjacent points 137 spaced apart from one another a fixed distance (approximately 30 degrees apart from one another relative to the longitudinal axis). Each ridge 137 has a generally triangular shape in lateral cross-section. As will be described further in detail below, socket 113 is adapted to fit over a rounded operating nut through open front end 127. Furthermore, by applying a significant force onto socket 113, ridges 137 are designed to engage (i.e., dig into) the outer surface of the rounded nut. In this manner, socket 113 is able to effectively grab and turn a rounded nut, which is a principal object of the present invention.

It should be noted that front piece 123 may be constructed in various sizes to accommodate different sized operating nuts. For example, if socket assembly 111 is to be used to turn a standard two-inch square operating nut of a conventional gate valve, front piece 123 may be constructed in multiple sizes to accommodate variances in the diameter of the rounded nut (e.g., 1.625 inch, 1.75 inch, and 1.875 inch varieties).

Closed rear end 129 is shaped to include a central circular opening 139 through which fastener 117 can be disposed, as will be described further below. In addition, closed rear end 129 is shaped to include four circular openings 141 that are equidistantly spaced about opening 139. It should be noted that openings 141 are provided in rear closed rear end 129 to facilitate the passage of socket 113 through dirt, grime or any other similar material that surrounds the rounded operating nut to be rotated.

As seen most clearly in FIGS. 3, 4(*b*) and 4(*c*), rear piece 125 includes a generally square-shaped base 143 and a narrow, rearwardly extending stem 145 which together define a longitudinally extending central bore 147 through which fastener 117 can protrude, as will be described further below. It should be noted that base 143 is sized and shaped to fittingly mount within the square-shaped key of a traditional gate valve wrench. It should also be noted that rear piece 125 is shaped to define a plurality of holes 149 which are disposed in axial alignment with openings 141 in front piece 123. Rear piece 125 terminates at a rear end 150.

Figure 5A:
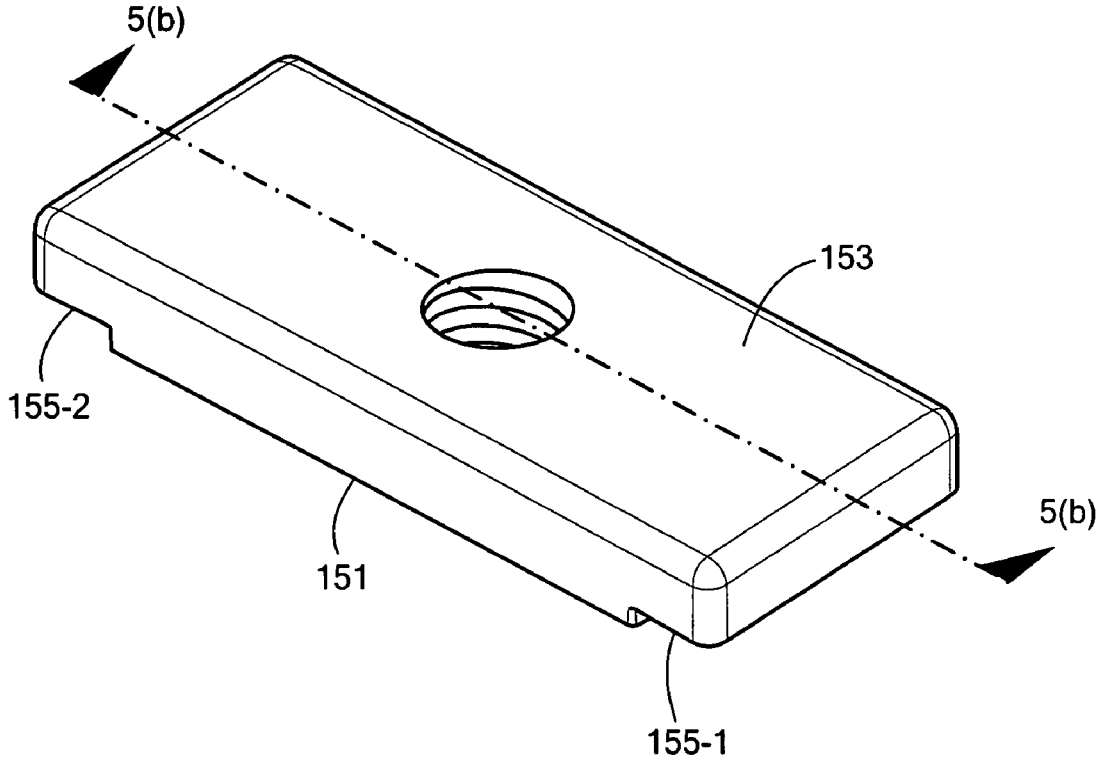
FIGS. 5(*a*) and 5(*b*) are top perspective and section views, respectively, of the support member shown in FIG. 3.
Figure 5B:
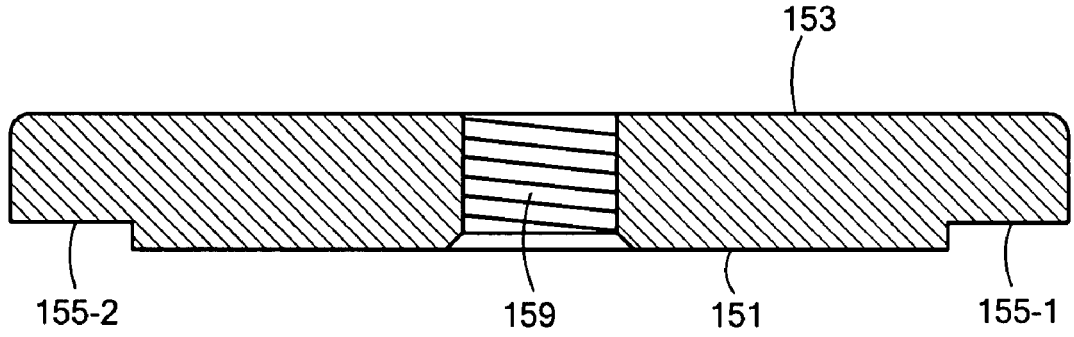

Referring now to FIGS. 3, 5(*a*) and 5(*b*), support member 115 is represented herein as being in the form of an elongated, rectangular plate that is constructed out of a rigid and durable material, such as steel. Support member 115 includes a substantially flat front surface 151 and a substantially flat rear surface 153, front surface 151 being stepped at opposing ends so as to define a pair of notches 155-1 and 155-2. As will be described further below, notches 155 are provided as means for retaining support member securely against the key of a conventional gate valve wrench.

Support member 115 is also shaped to define an elongated, threaded bore 159 that extends transversely through support member 115 from front surface 151 to rear surface 153. As will be described further below, bore 159 is sized and shaped to threadingly receive fastener 117 when socket assembly 111 is mounted on a gate valve wrench.

Referring now to FIG. 3, fastener 117 is represented herein as being in the form of a threaded bolt which includes an enlarged head 161 formed onto one end of an elongated stem 162 which is generally circular in lateral cross-section. An externally projecting, helical-style threading 163 is formed along a portion of the length of stem 162 at its free end. As will be described further in detail below, the strength of fastener 117 may be varied based on the intended use of socket assembly 111.

Washer 119 is sized and shaped to axially slide over the stem 162 of fastener 117. As will be described further below, washer 119 is used in conjunction with fastener 117 to retain socket 113 on a conventional gate valve wrench.

Method of Attaching Socket Assembly 111 to Wrench 21

Socket assembly 111 is adapted to be attached to a conventional gate valve wrench in the following manner. For purposes of simplicity only, socket assembly 111 will be shown attached to prior art wrench 21. However, it is to be understood that socket assembly 111 could be attached to other types of similarly designed wrenches without departing from the spirit of the present invention.

Figure 6:
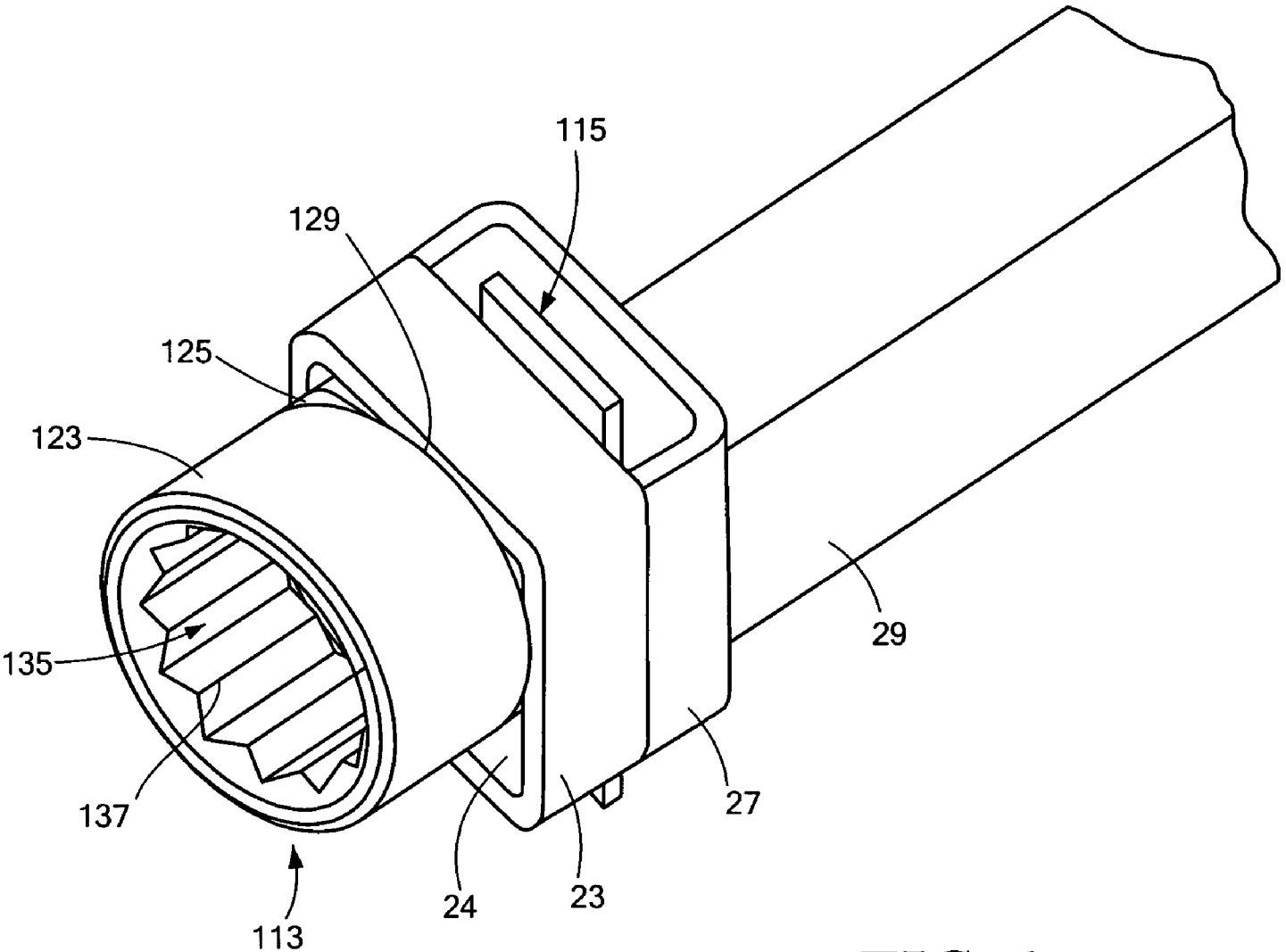
FIG. 6 is a fragmentary perspective view of the socket assembly shown in FIG. 3, the socket assembly being shown attached to the prior art gate valve wrench shown in FIG. 2.

To attach socket assembly 111 to wrench 21, rear piece 125 of socket 113 is inserted rearward through complementary-shaped opening 24 in key 23, as can be seen in FIG. 6. Because opening 24 in key 23 is complementary in shape with rear piece 125 of socket 113, socket 113 is incapable of rotation about its longitudinal axis when disposed within key 23 in this manner. Furthermore, with rear piece 125 positioned within opening 24, it is to be understood that rear end 129 of front piece 123 abuts against the front edge of key 23 at selected locations. Disposed as such, front piece 123 extends considerably out beyond the front edge of key 23.

With socket 113 mounted within opening 24 in wrench 21, support member 115 is positioned transversely across the rear edge of key 23, as shown in FIG. 6. Preferably, support member 115 is disposed such that the rear edge of key 23 aligns within notches 155 and thereby prevents support member 115 from longitudinally sliding along the rear edge of key 23.

With socket 113 and support member 115 mounted on wrench 21 as set forth above, washer 119 is axially mounted on stem 162 of fastener 117. In turn, the free end of fastener 117 is inserted axially through central circular opening 139 and central bore 147 in socket 113. Fastener 117 is inserted further through socket 113 until its free end threadingly engages with bore 159 in support member 115.

Fastener 117 is then axially rotated in the clockwise direction (e.g., by mounting a hex wrench over head 161) so that stem 162 penetrates through bore 159, the force of the rotation in turn pulling support member 115 tightly across the rear edge of key 23. Fastener 117 is further tightened until enlarged head 161 draws washer 119 in firm contact against closed rear end 129 of socket 113. In this manner, it is to be understood that support member 115, fastener 117 and washer 119 together serve to retain socket 113 securely fixed in place on key 23 of wrench 21 (i.e., incapable of longitudinal and/or rotational displacement relative to key 23).

Method of Operating a Gate Valve Using Socket Assembly 111 and Wrench 21

Socket assembly 111 and wrench 21 can be used together to operate a gate valve with a rounded operating nut in the following manner. Specifically, with socket assembly 111 mounted on wrench 21 in the manner noted above, wrench 21 is manipulated by the user using handle 31 such that socket 113 is disposed directly above the operating nut for the gate valve.

Preferably, socket 113 is sized and shaped so that the operating nut is slightly too large to fit within cavity 135 in socket 113. Accordingly, with socket 113 positioned directly over the operating nut, a substantial downward force is applied to wrench 21. For example, handle 31 may be struck with a hammer or other similar instrument. This application of force onto wrench 21 urges socket 113 down over the operating nut, with each of the twelve separate ridges 137 in socket 113 biting and digging into the outer surface of the operating nut as the socket 113 is urged downward. With socket 113 now engaging the operating nut, handle 31 of wrench 21 can be rotated as needed to open or close the gate valve. It should be noted that, because socket 113 bites deeply into the rounded nut, the user can rotate handle 31 back and forth a number of times to loosen a stuck gate mechanism (this process often being referred to as "working the gate" in the art).

Once the gate valve is disposed in its desired state, wrench 21 and socket 113 can be removed from the nut by applying a significant upward force onto wrench 21 (e.g., by striking handle 31 upward with a hammer). The application of an upward force onto wrench 21 ultimately causes ridges 137 to disengage from the operating nut, thereby disconnecting wrench 21 and socket 113 from the operating nut.

It should be noted that the inexpensive, small and lightweight nature of socket assembly 111 allows for its broad dissemination amongst municipal workers who are frequently required to operate gate valves. As a result, in the case of an emergency, socket assembly 111 can be readily mounted on a wrench 21 and used to quickly open and/or close a gate valve, thereby minimizing harm and inconvenience to the public, which is highly desirable.

Method of Capping a Rounded Operating Nut with Socket 113

Socket assembly 111 can be used in connection with wrench 21 to operate a gate valve with a rounded operating nut in the manner described in detail above. In addition, it is to be understood that socket assembly 111 can be used in connection with wrench 21 to permanently cap a rounded operating nut. In this manner, the rounded operating nut can be effectively reconfigured into its original 2-inch square shape along a portion of its length, which is highly desirable.

Specifically, socket assembly 111 is attached to wrench 21 in the manner set forth above (and as represented in FIG. 6). An adhesive (not shown), such as a fast curing epoxy, is then deposited into cavity 135. With the adhesive deposited as such, wrench 21 is then manipulated by the user using handle 31 such that socket 113 is disposed directly above the operating nut for the gate valve.

It is to be understood that socket 113 is preferably sized and shaped so that the operating nut is slightly too large to fit within cavity 135 in socket 113. Accordingly, with socket 113 positioned directly over the operating nut, a substantial downward force is applied to wrench 21 which in turn urges socket 113 down over the operating nut, with each of the twelve separate ridges 137 in socket 113 biting and digging into the outer surface of the rounded operating nut as the socket 113 is urged downward. It should be noted that, as a part of an optional preliminary step, the operating nut may be suitably treated to facilitate the adhesion process (e.g., the operating nut may be drilled, grinded, cleaned, etc.).

With socket 113 now engaging the operating nut, the adhesive located within cavity 135 is allowed to cure, thereby permanently bonding socket 113 to the rounded operating nut. At that time, wrench 21 is urged upwardly (e.g., by striking handle 31 with a hammer) with sufficient force so as to break fastener 117 and/or support member 115. To facilitate breakage of fastener 117 and/or support member 115, fastener 117 and/or support member 115 may be constructed of a material that will break under the desired conditions (e.g., a low tensile strength plastic).

Having severed fastener 117 and/or support member 115, wrench 21 can be separated from the gate valve, with socket 113 now permanently mounted over the operating nut. Because rear piece 125 is square shaped in cross-section along apportion of its length, socket 113 serves to provide the rounded operating nut with a square shaped section that can be manipulated using a conventional gate valve wrench, which is highly desirable. Furthermore, it should be noted that socket 113 is preferably painted a bright color (e.g., florescent orange) to enhance its visibility underground.

The embodiment shown of the present invention is intended to be merely exemplary and those skilled in the art shall be able to make numerous variations and modifications to them without departing from the spirit of the present invention. All such variations and modifications are intended to be within the scope of the present invention as defined in the appended claims.

What is claimed is:

1. A socket assembly adapted for attachment to a wrench, the wrench including a key coupled to an elongated T-bar, the key being shaped to define a square-shaped central opening, the socket assembly comprising:

(a) a socket, wherein the socket comprises a first piece and a second piece, said first piece including an open front end, a rear end, an inner surface and an outer surface, the inner surface being shaped to include a plurality of inwardly protruding ridges, said second piece being connected to the first piece, the second piece being adapted to be fittingly disposed within the central opening in the key of the wrench;

(b) a support member in the form of a plate that is adapted to mount on the wrench; and (c) a fastener for connecting the socket to the support member;

(d) wherein the socket further includes a longitudinal axis extending from said open front end of said first piece to a rear end of said second piece, a primary opening extending along said longitudinal axis for receiving said fastener, and a plurality of secondary openings extending parallel to said primary opening.

2. The socket assembly as claimed in claim 1 wherein each ridge is generally triangular in lateral cross-section.

3. The socket assembly as claimed in claim 1 wherein the support member includes a substantially flat front surface and a substantially flat rear surface.

4. The socket assembly as claimed in claim 3 wherein a pair of notches are formed in the front surface of the support member at opposing ends, the pair of notches being sized and shaped to receive a portion of the key when the support member is mounted on the wrench.

5. The socket assembly as claimed in claim 4 wherein the support member is shaped to define a threaded bore through which the fastener is inserted.

6. The socket assembly as claimed in claim 5 wherein the fastener is in the form of a threaded bolt with an enlarged head.

7. The socket assembly as claimed in claim 6 wherein the threaded bolt is configured to threadably engage the threaded bore in the support member.

8. The combination of a socket assembly and a wrench, the wrench including a key coupled to an elongated T-bar, the key being shaped to define a square-shaped central opening, the socket assembly comprising:

(a) a socket, wherein the socket comprises a first piece and a second piece, said first piece including an open front end, a rear end, an inner surface and an outer surface, the inner surface being shaped to include a plurality of inwardly protruding ridges, said second piece being connected to the first piece, the second piece being fittingly disposed within the square-shaped central opening of the key;

(b) a support member in the form of a plate that is adapted to mount on the wrench; and (c) a fastener for connecting the socket to the support member;

(d) wherein the socket further includes a longitudinal axis extending from said open front end of said first piece to a rear end of said second piece, a primary opening extending along said longitudinal axis for receiving said fastener, and a plurality of secondary openings extending parallel to said primary opening; and;

(e) wherein the second piece is retained within the square-shaped central opening of the key by the support member and the fastener.

* * * * *